US008452592B2

(12) United States Patent
Takatani et al.

(10) Patent No.: US 8,452,592 B2
(45) Date of Patent: May 28, 2013

(54) SIGNAL SEPARATING APPARATUS AND SIGNAL SEPARATING METHOD

(75) Inventors: Tomoya Takatani, Nissin (JP); Jani Even, Shiki-gun (JP)

(73) Assignees: Toyota Jidosha Kabushiki Kaisha, Toyota-shi (JP); National University Corporation Nara Institute of Science and Technology, Ikoma-shi (JP)

( * ) Notice: Subject to any disclaimer, the term of this patent is extended or adjusted under 35 U.S.C. 154(b) by 351 days.

(21) Appl. No.: 12/921,974

(22) PCT Filed: Sep. 2, 2008

(86) PCT No.: PCT/JP2008/065717

§ 371 (c)(1),
(2), (4) Date: Sep. 10, 2010

(87) PCT Pub. No.: WO2009/113192

PCT Pub. Date: Sep. 17, 2009

(65) Prior Publication Data

US 2011/0029309 A1 Feb. 3, 2011

(30) Foreign Application Priority Data

Mar. 11, 2008 (JP) ..... 2008-061727

(51) Int. Cl.
*G10L 21/02* (2006.01)

(52) U.S. Cl.
USPC ..... 704/226; 704/227; 704/228

(58) Field of Classification Search
USPC ..... 704/208, 214, 226–228, 233
See application file for complete search history.

(56) References Cited

U.S. PATENT DOCUMENTS

| | | | | |
|---|---|---|---|---|
| 6,990,447 | B2 * | 1/2006 | Attias et al. | 704/240 |
| 7,315,816 | B2 * | 1/2008 | Gotanda et al. | 704/226 |
| 7,363,221 | B2 * | 4/2008 | Droppo et al. | 704/226 |
| 7,533,017 | B2 * | 5/2009 | Gotanda et al. | 704/226 |
| 8,024,184 | B2 * | 9/2011 | Takiguchi et al. | 704/227 |
| 8,131,543 | B1 * | 3/2012 | Weiss et al. | 704/233 |
| 8,280,724 | B2 * | 10/2012 | Chazan et al. | 704/206 |
| 2004/0002858 | A1 * | 1/2004 | Attias et al. | 704/226 |

(Continued)

FOREIGN PATENT DOCUMENTS

| | | |
|---|---|---|
| JP | 2004-145172 A | 5/2004 |
| JP | 2004-302122 A | 10/2004 |

(Continued)

OTHER PUBLICATIONS

Noboru Nakasako, et al., "Basis of Independent Component Analysis and Acoustic Signal Processing", Systems, Control and Information, vol. 46, No. 7, 2002, The Institute of Systems, Control and Information Engineers, Jul. 15, 2002, pp. 400-408.

(Continued)

*Primary Examiner* — Douglas Godbold
(74) *Attorney, Agent, or Firm* — Kenyon & Kenyon LLP

(57) ABSTRACT

Provided are a signal separating apparatus and a signal separating method capable of solving the permutation problem and separating user speech to be extracted. The signal separating apparatus separates a specific speech signal and a noise signal from a received sound signal. First, a joint probability density distribution estimation unit of a permutation solving unit calculates joint probability density distributions of the respective separated signals. Then, a classifying determination unit of the permutation solving unit determines classifying based on shapes of the calculated joint probability density distributions.

11 Claims, 6 Drawing Sheets

U.S. PATENT DOCUMENTS

| | | | | |
|---|---|---|---|---|
| 2005/0043945 | A1* | 2/2005 | Droppo et al. | 704/226 |
| 2007/0055511 | A1* | 3/2007 | Gotanda et al. | 704/233 |
| 2009/0164212 | A1* | 6/2009 | Chan et al. | 704/226 |

FOREIGN PATENT DOCUMENTS

| | | | |
|---|---|---|---|
| JP | 2005-258068 | A | 9/2005 |
| JP | 2006-178314 | A | 7/2006 |
| JP | 2006-330687 | A | 12/2006 |
| WO | 2006/085537 | A1 | 8/2006 |

OTHER PUBLICATIONS

Shiro Ikeda, et al., "A Method of ICA in Time-Frequency Domain", Proc., ICA'99, 1999, pp. 365-371.

Shiro Ikeda, "Binaural Prcoessing and Independent Component Analysis", The Acoustical Society of Japan, Mar. 2002, vol. 58, No. 3, pp. 199-204.

Futoshi Asano, et al., "A Combined Approach of Array Processing and Independent Component Analysis for Blind Separation of Acoustic Signals", Proc. ICASSP2001, 2001, 4 pages.

Futoshi Asano, et al., "On the permutation in the frequency-domain blind signal separation", Technical report of IEICE. EA2001-19, 2001, vol. 101, No. 134, pp. 9-16.

Satoshi Kurita, et al., "Evaluation of Blind Signal Separation Method Using Directivity Pattern Under Reverberant Conditions", Proc. ICASSP2000, 2000, pp. 3140-3143.

Hiroshi Saruwatari, "Blind Source Separation Using Array Signal Processing", Technical Report of IEICE. EA2001-7, 2001, vol. 101, No. 31-32, pp. 49-56.

Jani Even, et al., "An Improved permutation solver for blind signal separation based front-ends in robot audition", IEEE/RSJ International Conference on Intelligent Robots and Systems (IROS2008), Sep. 2008, pp. 2172-2177.

Jani Even, et al., "Separation of Speech and Background Noise by Frequency Domain Blind Signal Separation based on Score Function Difference", Nara Institute of Science and Technology, 4 pages, 2007.

* cited by examiner

SIGNAL SEPARATING APPARATUS AND SIGNAL SEPARATING METHOD

This is a 371 national phase application of PCT/JP2008/065717 filed 2 Sep. 2008, claiming priority to Japanese Patent Application No. JP 2008/061727 filed 11 Mar. 2008, the contents of which are incorporated herein by reference.

TECHNICAL FIELD

The present invention relates to a signal separating apparatus and a signal separating method that extract a specific signal in the state where a plurality of signals are mixed in a space and, particularly to permutation solving technology.

BACKGROUND ART

Recently, a technique of extracting only user speech in hands-free by using microphone array has been developed. In a system to which such speech extraction technique is applied, it is necessary to suppress such noise in order to recognize the user speech correctly, because uttered speech (interference sound) other than the user speech to be extracted and diffusive noise called ambient noise are generally mixed in the user speech.

As a processing technique for suppressing noise, frequency domain independent component analysis is effective for use that assumes that sound sources are independent, applies learning rule for filtering in the frequency domain, and separates sound sources. In this technique, filters should be classified as a filter designed for extracting sound source of user speech or noise because the filter is designed in each frequency band. Such classifying is called "solution of the permutation (transpose) problem". When the solution is failed, even if user speech to be extracted and noise are appropriately separated in each frequency band in the independent component analysis, a sound with a mixture of user speech and noise is eventually output.

For example, a technique related to the solution of the permutation problem is proposed in Patent Document 1. In the system disclosed in this document, short-time Fourier transform is performed on observed signals, separating matrixes are obtained at each frequency by the independent component analysis, the arrival directions of the signals extracted from each row of the separating matrixes at each frequency are estimated, and it is determined whether the estimated values are reliable enough. Further, the similarity of separated signals between frequencies is calculated, and separating matrixes are obtained at each frequency, and, after that, the permutation is solved.

FIG. 6 shows an exemplary configuration of a permutation solving unit. The permutation solving unit 24 includes a sound source direction estimation unit 243 and a classifying determination unit 242. The sound source direction estimation unit 243 estimates the arrival directions of the signals extracted by each row of the separating matrixes at each frequency. The classifying determination unit 242 determines the permutation for frequencies at which the estimation of the arrival directions of the signals executed by the sound source direction estimation unit 243 is determined to be reliable enough by aligning those directions, and determines the permutation for the other frequencies so as to increase the similarity of the separated signals with the frequencies in proximity.

[Patent Document 1]

Japanese Unexamined Patent Application Publication No. 2004-145172

DISCLOSURE OF INVENTION

Technical Problem

In the technique of solving the permutation problem disclosed in Patent Document 1, it is assumed that noise is a point sound source which is emitted from a single point, and classifying is performed on the basis of the source angles estimated in each frequency band. However, in the case of diffusive noise, because the direction of the noise cannot be identified, estimation errors in the classifying become larger, and a desired operation cannot be performed in spite of the similarity calculation in the subsequent stage.

The present invention has been accomplished to solve the above problems and an object of the present invention is thus to provide a signal separating apparatus and a signal separating method that can correctly solve the permutation problem and separate user speech to be extracted.

Technical Solution

A signal separating apparatus according to the present invention is a signal separating apparatus that separates a specific speech signal and a noise signal from a received sound signal, which includes a signal separating unit that separates at least a first signal and a second signal in the sound signal, a joint probability density distribution calculation unit that calculates joint probability density distributions of the first signal and the second signal separated by the signal separating unit, and a classifying determination unit that determines the first signal and the second signal as the specific speech signal or the noise signal based on shapes of the joint probability density distributions calculated by the joint probability density distribution calculation unit.

The classifying determination unit preferably determines a signal with a non-Gaussian shape of the joint probability density distribution as the specific speech signal and determines a signal with a Gaussian shape as the noise signal.

It is also preferred that the classifying determination unit discriminates between the specific speech signal and the noise signal based on distribution widths in the shapes of the joint probability density distributions.

It is further preferred that the classifying determination unit discriminates between the specific speech signal and the noise signal based on distribution widths at a frequent value determined on basis of a most frequent value in the shapes of the joint probability density distributions.

Further, the signal separating unit preferably separates the first signal and the second signal for each of a plurality of frequencies contained in the received sound signal.

A robot according to the present invention includes the above-described signal separating apparatus, and a microphone array composed of a plurality of microphones that supply sound signals to the signal separating apparatus.

A signal separating method according to the present invention is a signal separating method that separates a specific speech signal and a noise signal from a received sound signal, which includes a step of separating at least a first signal and a second signal in the sound signal, a step of calculating joint probability density distributions of the first signal and the second signal, and a step of determining the first signal and the second signal as the specific speech signal or the noise signal based on shapes of the calculated joint probability density distributions.

It is preferred that a signal with a non-Gaussian shape of the joint probability density distribution is determined as the specific speech signal, and a signal with a Gaussian shape is determined as the noise signal.

It is also preferred that the specific speech signal and the noise signal are discriminated based on distribution widths in the shapes of the joint probability density distributions.

It is further preferred that the specific speech signal and the noise signal are discriminated based on distribution widths at a frequent value determined on basis of a most frequent value in the shapes of the joint probability density distributions.

Further, it is preferred that the first signal and the second signal are separated for each of a plurality of frequencies contained in the received sound signal.

ADVANTAGEOUS EFFECTS

According to the present invention, it is possible to provide a signal separating apparatus and a signal separating method that can correctly solve the permutation problem and separate user speech to be extracted.

EXPLANATION OF REFERENCE

1 A/D CONVERSION UNIT
2 NOISE SUPPRESSION UNIT
3 SPEECH RECOGNITION UNIT
21 DISCRETE FOURIER TRANSFORM UNIT
22 INDEPENDENT COMPONENT ANALYSIS UNIT
23 GAIN CORRECTION UNIT
24 PERMUTATION SOLVING UNIT
25 INVERSE DISCRETE FOURIER TRANSFORM UNIT
241 JOINT PROBABILITY DENSITY DISTRIBUTION ESTIMATION UNIT
242 CLASSIFYING DETERMINATION UNIT
243 SOUND SOURCE DIRECTION ESTIMATION UNIT

BEST MODE FOR CARRYING OUT THE INVENTION

Figure 1:
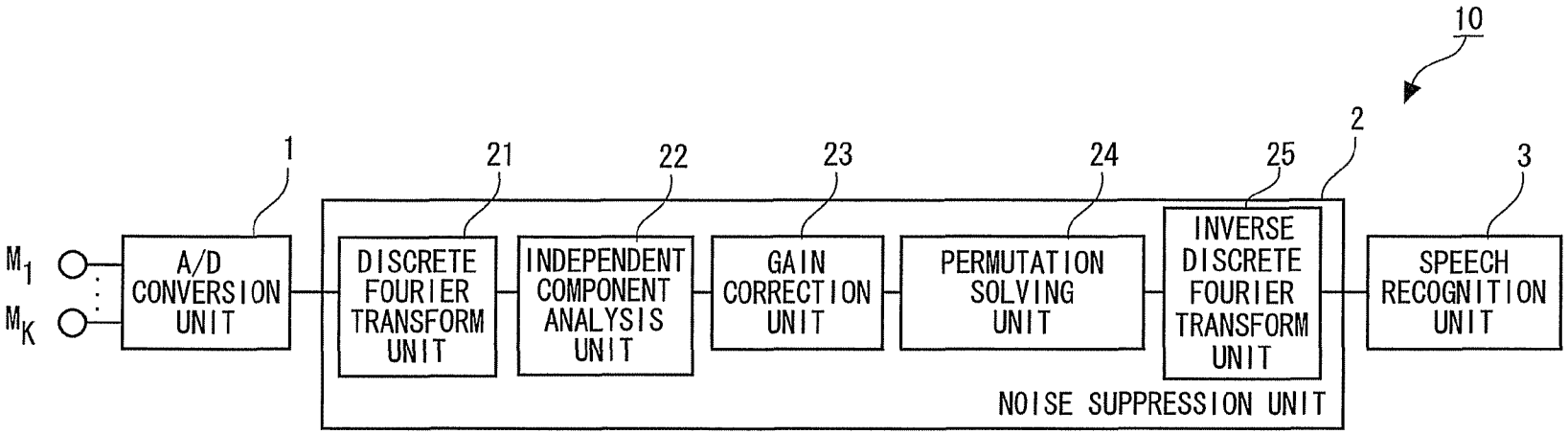
FIG. 1 is a block diagram showing the overall configuration of a signal separating apparatus according to the present invention.

First, the overall configuration and processing of a signal separating apparatus according to an embodiment of the present invention are described with reference to the block diagram of FIG. 1.

As shown therein, a signal separating apparatus 10 includes an analog/digital (A/D) conversion unit 1, a noise suppression unit 2, and a speech recognition unit 3. A microphone array composed of a plurality of microphones M1 to Mk is connected to the signal separating apparatus 10, and sound signals detected by the respective microphones are received to the microphone apparatus 10. The signal separating apparatus 10 is incorporated into a guide robot placed in a show room or an event site or other robots, for example.

The A/D conversion unit 1 converts the respective sound signals received from the microphone array M1 to Mk into digital signals, which are sound data, and outputs the data to the noise suppression unit 2.

The noise suppression unit 2 executes process of suppressing noise contained in the received sound data. As shown in the figure, the noise suppression unit 2 includes a discrete Fourier transform unit 21, an independent component analysis unit 22, a gain correction unit 23, a permutation solving unit 24, and an inverse discrete Fourier transform unit 25.

The discrete Fourier transform unit 21 executes discrete Fourier transform for each of the sound data corresponding to the respective microphones and identifies the time series of the frequency spectra.

The independent component analysis unit 22 performs independent component analysis (ICA) based on the frequency spectra received from the discrete Fourier transform unit 21 and calculates separating matrixes at each frequency. Specific processing of the independent component analysis is disclosed in detail in Patent Document 1, for example.

The gain correction unit 23 executes gain correction process on the separating matrixes at each frequency calculated by the independent component analysis unit 22.

The permutation solving unit 24 executes process for solving the permutation problem. Specific processing is described in detail later.

The inverse discrete Fourier transform unit 25 executes inverse discrete Fourier transform and converts the frequency domain data into time domain data.

The speech recognition unit 3 executes speech recognition process based on the sound data whose noise is suppressed by the noise suppression unit 2.

Figure 2:
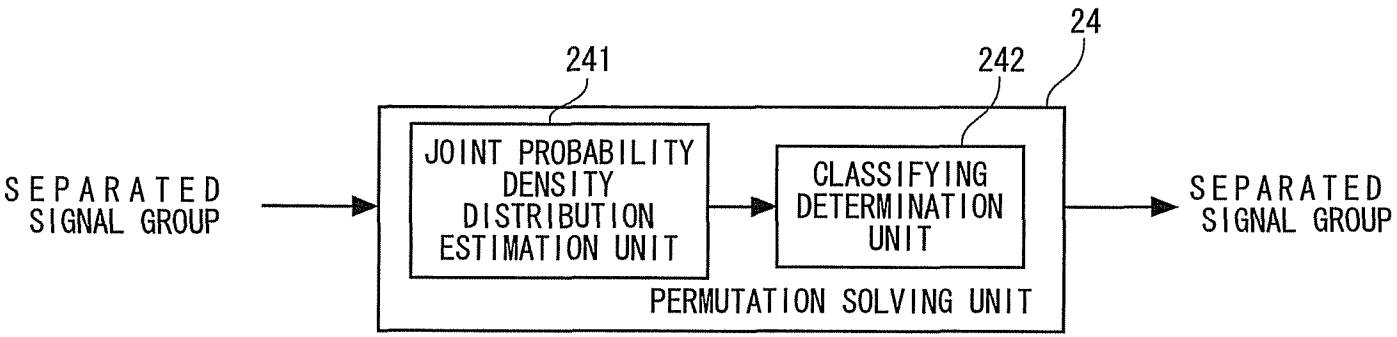
FIG. 2 is a block diagram showing the configuration of a permutation solving unit according to the present invention.

The configuration and processing of the permutation solving unit 24 are described hereinafter with reference to the block diagram of FIG. 2. As shown in FIG. 2, the permutation solving unit 24 includes a joint probability density distribution estimation unit 241 and a classifying determination unit 242.

The joint probability density distribution estimation unit 241 calculates joint probability density distributions of the separated signals at each frequency and calculates their joint probability density distributions.

The classifying determination unit 242 determines classifying on the basis of the shapes of the joint probability density distributions estimated by the joint probability density distribution estimation unit 241. Specifically, the classifying determination unit 242 determines whether the joint probability density distribution shape is a non-Gaussian signal which is specific to user speech or a Gaussian signal of noise over a wide range.

Figure 4:
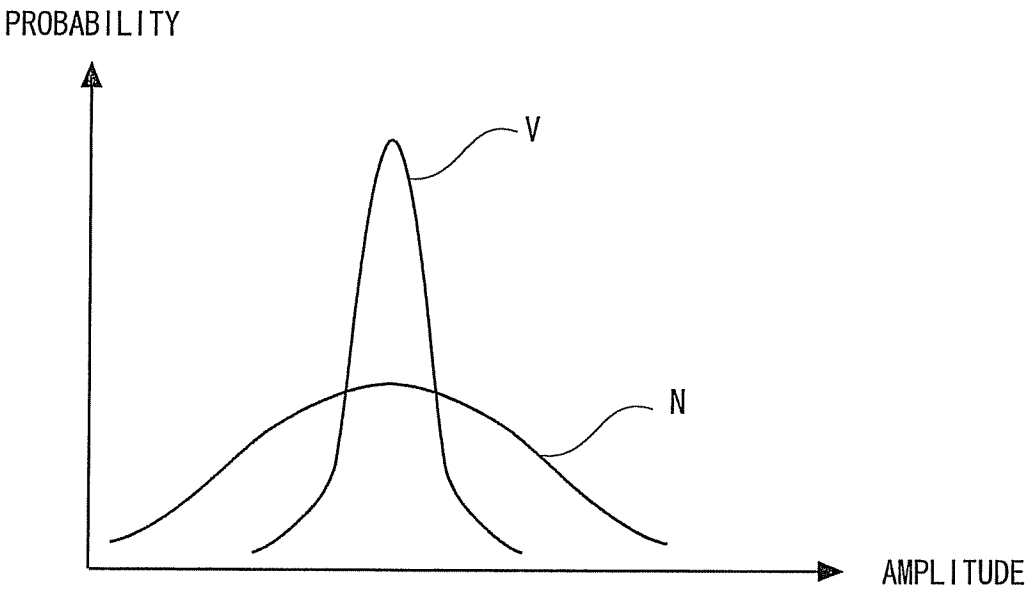
FIG. 4 is a graph showing an example of joint probability density distributions of separated signals.

FIG. 4 shows an example of joint probability density distribution shapes. In the figure, V is user speech, and N is noise. The user speech V is generally a non-Gaussian signal, which has a steep shape with specific amplitude at its peak. On the other hand, the noise is distributed over a wider range than the user speech V. Therefore, comparing the user speech V and the noise N, the amplitude distribution width at the frequent value determined based on the maximum value, the average value or the like is narrower for the user speech V than for the noise N.

In actual processing, the classifying determination unit 242 calculates the value of the distribution width when the frequent value is reduced from the maximum value at a constant rate in the joint probability density distribution is calculated for each of the separated signals. Then, comparing those distribution widths, it determines the separated signal which is determined to have a small distribution width as user speech and determines the one with a large distribution width as noise.

Figure 3:
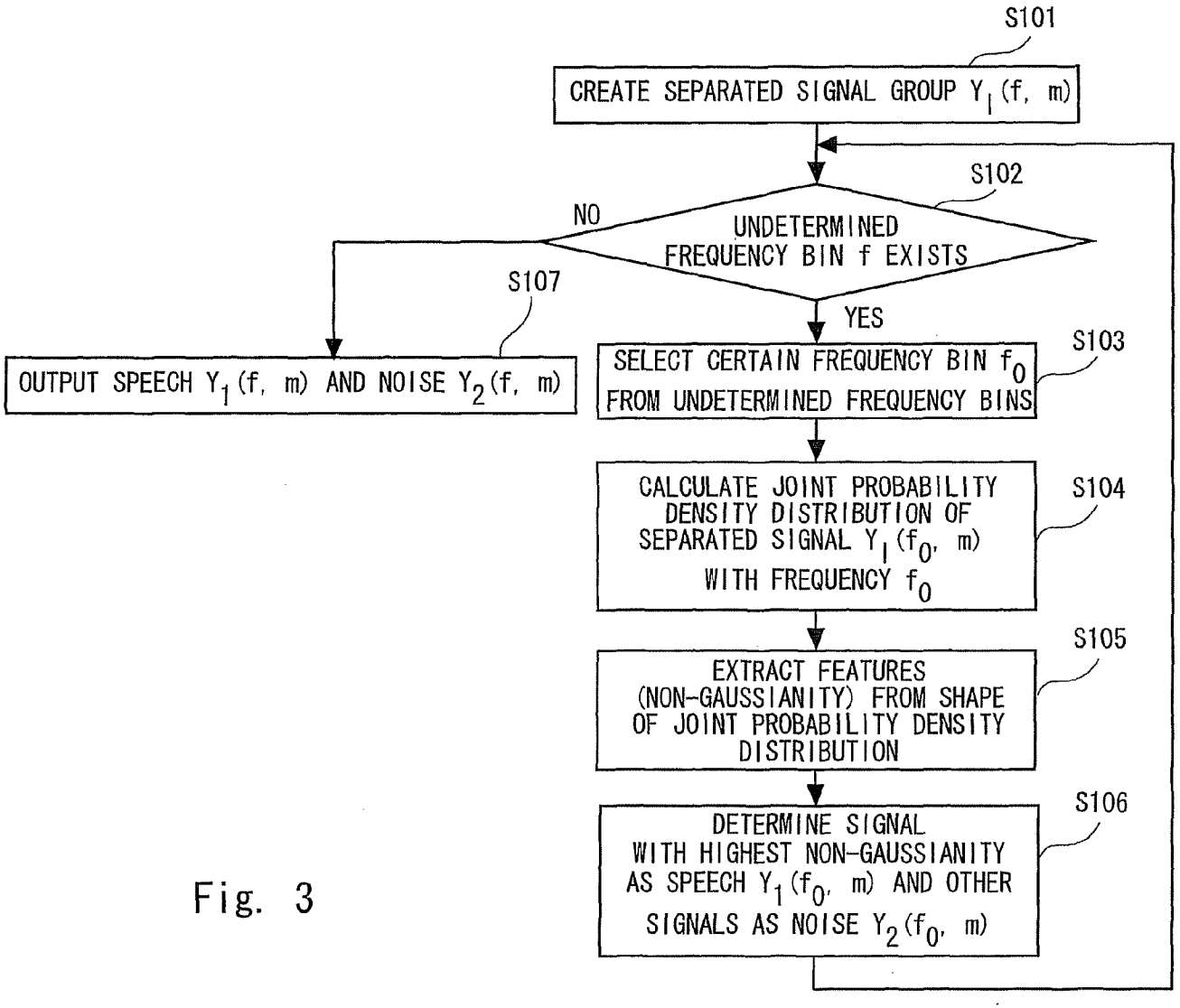
FIG. 3 is a flowchart showing a flow of a signal separating process according to the present invention.

The process of solving the permutation problem is specifically described hereinafter with reference to the flowchart of FIG. 3.

First, the independent component analysis unit 22 or the like creates a separated signal group $Y_1$ (f, m) composed of a plurality of separated signals (S101). Note that 1 is a group number, f is a frequency-bin, and m is a frame number. Next, the joint probability density distribution estimation unit 241 of the permutation solving unit 24 determines whether there is an undetermined frequency-bin (S102). When, as a result of the determination, the joint probability density distribution estimation unit 241 determines that there is an undetermined frequency-bin, it selects $f_0$ from the undetermined frequency-bin (S103).

Then, the joint probability density distribution estimation unit 241 calculates the joint probability density distribution of the separated signal group $Y_1$ ($f_0$, m) with the frequency $f_0$ (S104). Next, the classifying determination unit 242 extracts features (non-Gaussian characteristic) from the shape of the calculated joint probability density distribution of the separated signal group $Y_1$ ($f_0$, m) with the frequency $f_0$ (S105).

Based on the extracted features, the classifying determination unit 242 determines a signal with the highest non-Gaussian characteristic as speech $Y_1$ ($f_0$, m) and the other signal as noise $Y_2$ ($f_0$, m) (S106). After that, the process returns to the processing of Step S102.

When it is determined in Step S102 that there is no undetermined frequency-bin, speech $Y_1$ (f, m) and noise $Y_2$ (f, m) indicating a result of classifying into user speech or noise at each frequency are output.

Figure 5A:
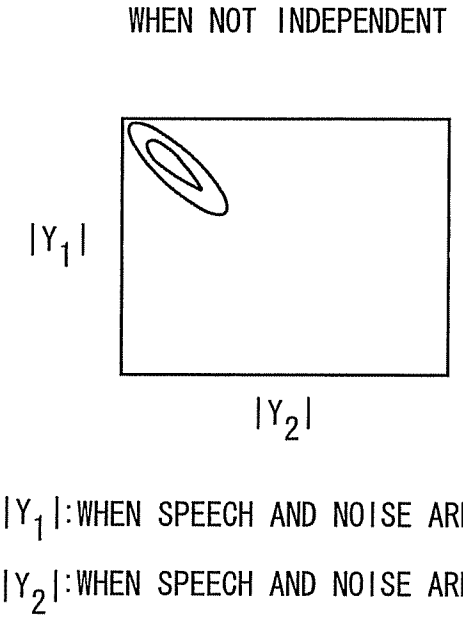
FIG. 5A is a view to describe a result of verification about a signal separating method according to the present invention.

Results of verifying a signal separating method according to the embodiment are described hereinafter with reference to FIGS. 5A to 5C. In each figure, an outline part indicates the existence of a signal. FIG. 5A shows the case where speech and noise are mixed in each of the separated signal $Y_1$ ($f_0$, m) and the separated signal $Y_2$ ($f_0$, m), which is, where speech and noise are not independent. In this case, the similar signal waveforms are obtained on both of the $Y_1$ axis and the $Y_2$ axis.

Figure 5B:
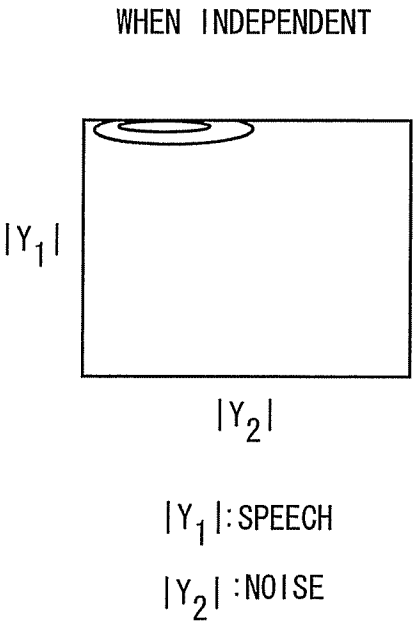
FIG. 5B is a view to describe a result of verification about a signal separating method according to the present invention.

FIG. 5B shows the case where the separated signal $Y_1$ ($f_0$, m) is speech, and the separated signal $Y_2$ ($f_0$, m) is noise. In this case, a non-Gaussian distribution is observed on the $Y_1$ axis, and a Gaussian distribution is observed on the $Y_2$ axis.

Figure 5C:
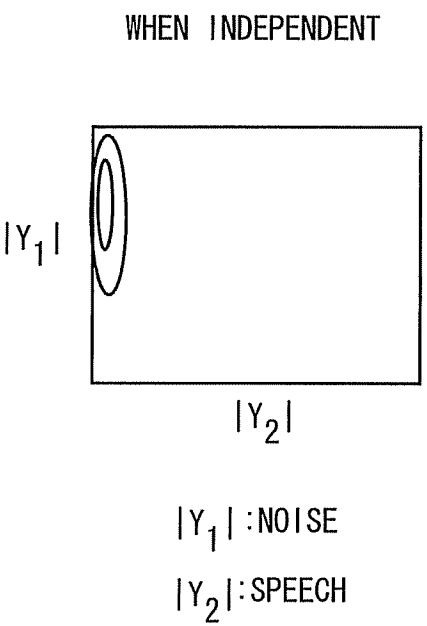
FIG. 5C is a view to describe a result of verification about a signal separating method according to the present invention.
Figure 6:
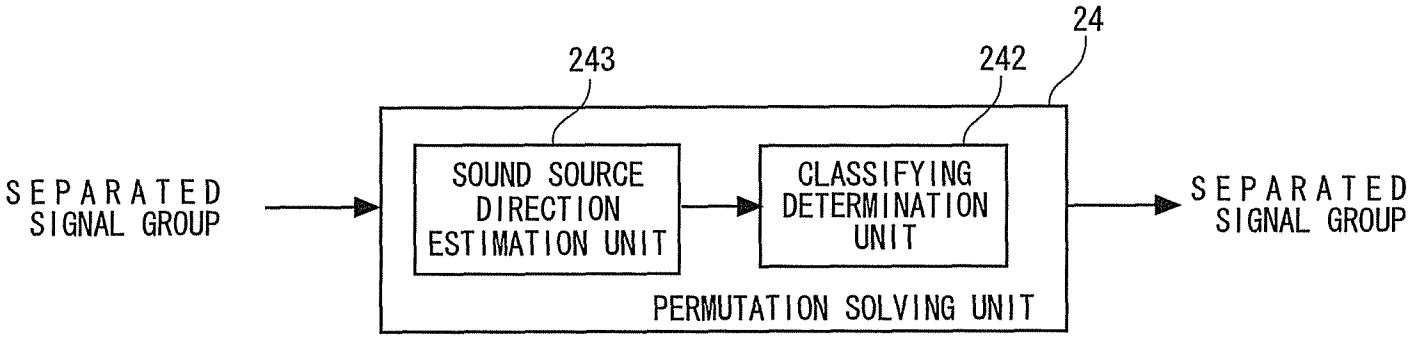
FIG. 6 is a block diagram showing the configuration of a permutation solving unit according to related art.

FIG. 5C shows the case where the separated signal $Y_1$ is noise, and the separated signal $Y_2$ is speech. In this case, a Gaussian distribution is observed on the $Y_1$ axis, and a non-Gaussian distribution is observed on the $Y_2$ axis. The analysis results show that the speech changes its place between $Y_1$ and $Y_2$ as illustrated in FIGS. 5B and 5C.

As described above, the signal separating apparatus according to the embodiment makes determination of the classifying on the basis of the shapes of the joint probability density distributions of the separated signals and is thus capable of accurately identifying which cluster the user speech is.

Industrial Applicability

The present invention is applicable to a signal separating apparatus and a signal separating method that extract a specific signal in the state where a plurality of signals are mixed in a space and, particularly to permutation solving technology.

The invention claimed is:

1. A signal separating apparatus that separates a specific speech signal and a noise signal from a received sound signal, comprising:

a transform unit for converting the data for the received sound signal from the time domain to the frequency domain;

a signal separating unit that separates at least a first signal and a second signal in the sound signal;

a joint probability density distribution estimation unit that selects a frequency bin from undetermined frequency bins;

a joint probability density distribution calculation unit that calculates joint probability density distributions of the first signal and the second signal with the selected frequency bin;

a classifying determination unit that determines the first signal and the second signal as the specific speech signal or the noise signal based on shapes of the joint probability density distributions calculated by the joint probability density distribution calculation unit, wherein the joint probability density distribution estimation unit, the joint probability density distribution calculation unit, and the classifying determination unit select, calculate, and determine until there are no more undetermined frequency bins.

2. The signal separating apparatus according to claim 1, being further programmed to determine a signal having a non-Gaussian shape of the joint probability density distribution as the specific speech signal and determines a signal having a Gaussian shape as the noise signal.

3. The signal separating apparatus according to claim 1, being further programmed to discriminate between the specific speech signal and the noise signal based on distribution widths in the shapes of the joint probability density distributions.

4. The signal separating apparatus according to claim 3, being further programmed to discriminate between the specific speech signal and the noise signal based on distribution widths at a frequent value determined on basis of a most frequent value in the shapes of the joint probability density distributions.

5. The signal separating apparatus according to claim 1, being further programmed to separate the first signal and the second signal for each of a plurality of frequencies contained in the received sound signal.

6. A robot comprising: the signal separating apparatus according to claim 1; and a microphone array composed of a plurality of microphones that supply sound signals to the signal separating apparatus.

7. A signal separating method that separates a specific speech signal and a noise signal from a received sound signal, comprising:

(a) converting the data for the received sound signal from the time domain to the frequency domain;

(b) separating at least a first signal and a second signal in the sound signal;

(c) selecting a frequency bin from undetermined frequency bins;

(d) calculating joint probability density distributions of the first signal and the second signal with the selected frequency bin;

(e) determining the first signal and the second signal as the specific speech signal or the noise signal based on shapes of the calculated joint probability density distributions; and (f) repeatedly performing steps (c) through (e) until there are no more undetermined frequency bins.

8. The signal separating method according to claim 7, wherein a signal having a non-Gaussian shape of the joint probability density distribution is determined as the specific speech signal, and a signal having a Gaussian shape is determined as the noise signal.

9. The signal separating method according to claim 7, wherein the specific speech signal and the noise signal are discriminated based on distribution widths in the shapes of the joint probability density distributions.

10. The signal separating method according to claim 9, wherein the specific speech signal and the noise signal are discriminated based on distribution widths at a frequent value determined on basis of a most frequent value in the shapes of the joint probability density distributions.

11. The signal separating method according to claim 7, wherein the first signal and the second signal are separated for each of a plurality of frequencies contained in the received sound signal.

* * * * *